United States Patent [19]

Buck et al.

[11] Patent Number: 4,476,941

[45] Date of Patent: Oct. 16, 1984

[54] MOTOR-DRIVEN HAND-HELD PERCUSSION TOOL

[75] Inventors: Manfred Buck, Nürtingen; Frank Müller, Leinfelden-Echterdingen II; Karl Wanner, Leinfelden-Echterdingen, all of Fed. Rep. of Germany

[73] Assignee: Robert Bosch GmbH, Stuttgart, Fed. Rep. of Germany

[21] Appl. No.: 424,993

[22] Filed: Sep. 27, 1982

[30] Foreign Application Priority Data

Jun. 29, 1982 [DE] Fed. Rep. of Germany ..... 3224176

[51] Int. Cl.[3] ..... B25D 17/00

[52] U.S. Cl. ..... 173/117; 173/131; 173/133; 173/139

[58] Field of Search ..... 173/117, 139, 128, 131, 173/133, 167 R, 129, 130, 132

[56] References Cited

U.S. PATENT DOCUMENTS

| | | | |
|---|---|---|---|
| 1,591,379 | 7/1926 | Hansen | 173/130 |
| 3,157,070 | 11/1964 | Heidrich | 173/132 |
| 3,191,694 | 6/1965 | Elliott et al. | 173/128 |
| 3,273,469 | 9/1966 | Doyle | 173/139 |
| 3,797,585 | 3/1974 | Ludvigson | 175/19 |
| 3,921,729 | 11/1975 | Schmuck | 173/117 |
| 4,015,671 | 4/1977 | Borison et al. | 173/117 |
| 4,029,158 | 6/1977 | Gerrish | 173/139 |
| 4,239,143 | 12/1980 | Johnson | 173/133 |
| 4,276,941 | 7/1981 | Wanner | 173/117 |

FOREIGN PATENT DOCUMENTS 1424473 2/1973 United Kingdom .

*Primary Examiner*—James M. Meister
*Assistant Examiner*—John L. Knoble
*Attorney, Agent, or Firm*—Michael J. Striker

[57] ABSTRACT

A hand-held motor-driven percussion tool comprises a piston driven over an air cushion and acting over an axially movable anvil on the inner end of a tool axially movable in a tool receiver provided at one end of a tool housing. The anvil has an annular collar located in the cavity of an impact body which is movable in the direction of the impact of the piston against a cushioning ring. The impact body has an abutment face adapted to be engaged by a collar of the anvil when the latter is driven by the piston. A face of the impact body facing away from the cushioning ring is directed toward a part fixedly connected with the tool housing. The mass of the impact body is for instance 10% greater than that of the anvil. If the tool during operation is withdrawn from a workpiece, then the flange of the anvil impinges upon the abutment face of the impact body and accelerates the latter towards the cushioning ring. The anvil reaches in a region adjacent the impinging location a rest position, so that the piston will not engage the anvil any longer, and further striking of the percussion tool will cease.

8 Claims, 3 Drawing Figures

MOTOR-DRIVEN HAND-HELD PERCUSSION TOOL

BACKGROUND OF THE INVENTION

The present invention relates to a hand-held percussion tool, for instance a percussion hammer, comprising a housing forming at one end a tool receiver, a tool axially guided in the tool receiver, a percussion piston coaxial with the axis of the tool, spaced from the inner end and axially reciprocatable in the housing, a motor-driven air cushion striking means cooperating with the percussion piston for reciprocating the latter, an elongated anvil reciprocatably guided between the inner end of the tool and the percussion piston and movable to an idle stroke position, with a rubber-elastic cushioning ring and an impact body coordinated with the cushioning ring and being guided movable in the longitudinal direction of the anvil and having an abutment face directed toward the anvil. In a known hand-held percussion tool there is arranged between a percussion piston, driven over an air cushion within a pot-shaped piston by a crank drive, and a tool receiver, in which the shaft of a tool is insertable, an anvil movable in the direction of the percussion piston between the latter and the shaft of the tool. The anvil is guided for reciprocation in a bushing. During the operation of the tool, the crank drive accelerates over the pot-shaped piston and the air cushion the percussion piston towards the anvil, so that the percussion piston abuts against the anvil and drives the latter towards the inserted tool. During abutment on the free end of the tool shaft, the anvil transmits at least a part of its kinetic energy onto the tool. Normally the anvil rebounds from the free end of the shaft towards the percussion piston to be again driven by the latter against the shaft of the tool. In order to avoid in such cases, in which, when the anvil reaches its starting position, the percussion piston still moves in the direction of the crank drive, that the anvil does exert a hard blow against the housing, there is provided an abutment ring for the anvil, which is guided in longitudinal direction of the latter, and braced by means of a ring of rubber or the like with respect to an axial abutment face rigid with the housing. After abutment of the anvil onto the abutment ring, both parts move together toward the abutment face, thereby compressing the elastic ring. Thereby both parts are braked. Due to the compressing stress thus built up in the elastic ring, the two parts are accelerated in a direction opposite the original movement of the anvil. Thereby the anvil may eventually again abut against the shaft and again rebound. The anvil of this tool has a neck-shaped part with a circumferential groove formed in the latter, and the elastic ring is constructed in such a manner that it can snap in the circumferential groove during movement of the neck-shaped part. The circumferential groove is arranged on the anvil in such a manner that the snap-in of the elastic ring will take place when the tool is for instance disengaged from the workpiece and therefore moves up to a stop built into the tool receiver. Due to the snapping-in of the elastic ring, the anvil is prevented from moving so far away from the end of the tool shaft so as to be located again in the stroke path of the percussion piston to be again accelerated by the latter in an unintended manner. The snapping-in will provide a so-called idle stroke position of the anvil. If the operation of the tool has to be renewed, the operator has to press the tool forcefully against the workpiece, so that the tool shaft will push the anvil out of its idle stroke position toward the percussion piston, and so that the latter will during its operation again abut against the anvil.

SUMMARY OF THE INVENTION

It is an object of the present invention to provide a hand-held percussion tool of the aforementioned kind which overcomes the disadvantage of the above-described percussion tool, that is a percussion tool in which the anvil can be moved with a considerably smaller force from its idle stroke position to its working position than is possible with tools of the prior art. This in turn will also facilitate the exact guidance of the tool during the start of the operation.

With these and other objects in view, which will become apparent as the description proceeds, the hand-held percussion tool according to the present invention mainly comprises a housing forming at one end a tool receiver having an axis, a tool axially guided in the tool receiver and having an inner end, a percussion piston coaxial with the axis spaced from the inner end of the tool and axially reciprocatable in the housing, a motor-driven air cushion striking means cooperating with the percussion piston for reciprocating the latter, an elongated anvil reciprocatably guided between the inner end of the tool and the percussion piston and movable to an idle stroke position, an impact body guided in the longitudinal direction of the elongated anvil and having an abutment face impingeable by the anvil, and a rubber-elastic cushioning ring sandwiched between a face of the impact body opposite the abutment face and a corresponding opposite face of the tool receiver, wherein the mass of the impact body is substantially equal to or at most is 30% greater than that of the anvil.

In this construction, the anvil movable in direction toward the inner end of the tool strikes, after withdrawal of the tool from the workpiece, against a mass movable relative to an elastic cushion and of such a size that the anvil upon abutment against this mass will first be arrested and then be moved with a very small speed in the opposite direction. Thereby the total kinetic energy of the abutting anvil will be practically transmitted onto the movable mass. Due to the friction between the anvil and a guiding bushing correlated therewith, the anvil will be arrested at a small distance from the percussion piston. In this position, the anvil will not be engaged by the percussion piston during reciprocation of the latter. Since, due to the mass relationship between the impact body and the anvil, the impact body will after the mentioned abutment not any longer engage the anvil, the transmitted energy will be completely disassociated from the anvil and transmitted to the housing of the tool. This is especially obtainable when the mass of the impact body is about 30% greater than that of the anvil. To renew the operation of the tool, it is therefore sufficient to overcome the friction forces occurring between the anvil and its guide bushing, so that the anvil will be brought again into the operating path of the percussion piston to be accelerated by the latter against the tool. If the percussion tool is operated in horizontal or downwardly inclined position, any known braking or holding devices for the anvil may therefore be dispensed with. Only if it is desired that the anvil can also be held in an upwardly inclined position of the tool in its idle stroke position, is it necessary to provide for a braking or holding device. The force exerted from such a device has, however, to be only strong enough in order to prevent sliding of the anvil due to its own weight toward the percussion piston. These forces are, however, considerably smaller than the forces necessary in the above-described construction of the prior art required for holding the anvil in its idle stroke position. The construction according to the present invention will assure that the hand-held percussion tool may be easily handled and that the engagement of the tool with the workpiece can be carried out in a precise manner even at a closely surrounded workpiece.

Preferably the housing has, rearwardly of the tool receiver a portion guiding the impact body and the cushioning ring has radially inwardly a portion elastically surrounding the inner end of the tool, so as to form a sealing ring and the cushioning ring has a radially outwardly extending portion having a peripheral surface radially spaced from the portion of the housing guiding the impact body.

Further features of the present invention will reduce noise during operation of the tool, and reduce likewise wear on the various parts thereof and will result in advantages in manufacturing the tool.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF A PREFERRED EMBODIMENT

Figure 1:
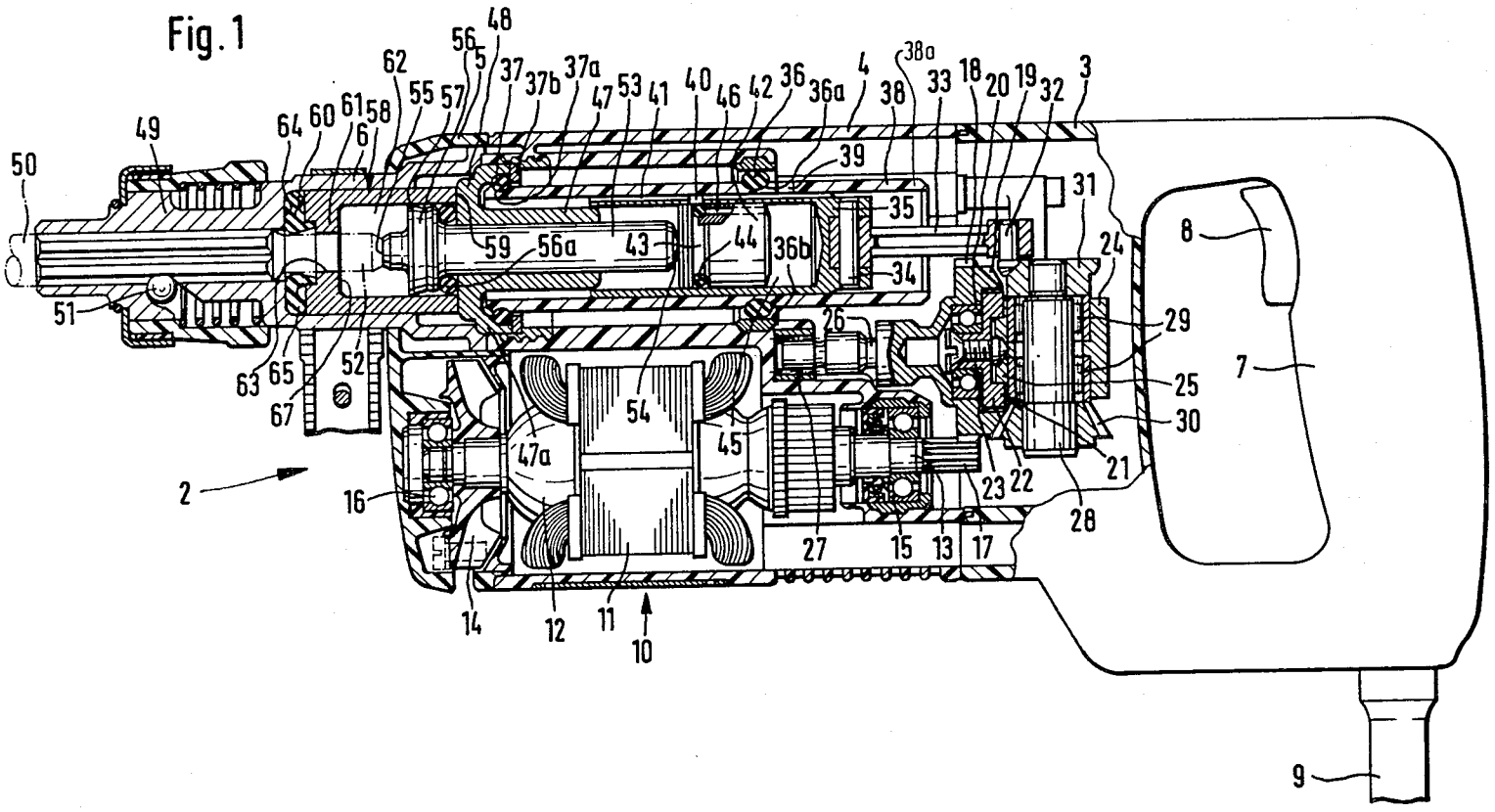
FIG. 1 is an axial cross section of the motor-driven hand-held percussion tool according to the present invention.

Referring now to the drawing, and more specifically to FIG. 1 of the same, it will be seen that the motor-driven hand-held percussion tool 2 is constructed as a percussion hammer and has a housing assembled from the housing parts 3, 4, 5 and 6. The housing part 3 has a handle 7 provided with a trigger switch 8 and a connecting cable 9. An electric drive motor 10 is arranged within the housing parts 4 and 5. The motor 10 has a stator 11, a rotor 12 with a shaft 13, a ventilator wheel 14 and two bearings 15 and 16. The free end of the shaft 13 which is directed toward the handle 7 is constructed as a pinion 17. The pinion 17 meshes with a spur gear 18, which carries on the side directed towards the handle 7 a bevel gearing 19. A ball bearing 20 is arranged in the interior of the spur gear 19. This ball bearing 20 is carried by a holding device 21 which comprises a centralizing collar 22 and a coaxial trunnion 23 integral therewith and extending into the ball bearing 20. A bearing block 24 is fastened to the housing part 3 and the bearing block has a central trunnion 25 extending into the central collar 22. A shaft 26 is integrally formed with the spur gear 18. This shaft extends into a needle bearing provided in the housing part 4 so as to prevent the spur gear 18 from tipping. A further shaft 28 extending transverse to the shaft 26 is mounted by means of needle bearings 29 in the bearing block 24. The shaft 28 carries at one end a bevel gear 30 meshing with the bevel gearing 19, and on the other end a crank disk 31. The crank disk 31 carries a crank pin 32 which engages with a connecting rod 33, which together with a connecting pin 34, the crank pin 32, the crank disk 31 and the shaft 28 forms a crank drive. The connecting pin 34 engages a pot-shaped piston 35 extending parallel to the rotor 12. The piston 35 is reciprocatable in a guide tube 38 carried by rubber-like elastic ring 36 and 37 in the housing part 4. The guide tube 38 preferably consists of plastic material reinforced by fibers 38*a* and is provided at its outer periphery with annular grooves 36*a* and 37*a* engaged by the elastic rings 36 and 37. The ring 36 engages with its outer periphery under pressure in a cylindrical bore 36*b* . The ring 37 is fixed in radial and axial direction by a projection 47*a* formed on a bushing 47. An annular disk 37*b*, placed in the housing part 4 in continuation of the projection 47*a* and fixed against axial displacement, fixes the ring 37 in the second axial direction. Thus, the ring 37 will act as an elastic stationary bearing, whereas the ring 36 is axially movable so as to permit heat expansion of the guide tube 38 and the housing part 4. This will prevent destruction of the aforementioned parts. The construction of the guide tube 38 from plastic material and the arrangement of the rings 36 and 37 will assure a low-noise operation of the apparatus. The rings 36 and 37 have, due to their elasticity, the additional advantage that the manufacturing tolerances for the guide tube 38 and the housing part 34 may be increased, which in turn will reduce their cost. Furthermore, these rings will act as damping elements for those radial components of shocks which during exchange of impulses between striking and stricken parts by eventually eccentric impingements occur and which should be kept away from the operator. A lubricating opening 39 is drilled in the guide tube 38 transverse to the axis thereof. The pot-shaped piston 35 has a ventilating opening 40, which during displacement of the pot-shaped piston 35 to its dead-center position adjacent the shaft 28 will be aligned with the lubricating opening 39. A ventilating groove 41 extending in the longitudinal direction of the pot-shaped piston 35 is provided at the outer periphery thereof and crossing the ventilating opening 40.

A percussion piston 42 is axially movably mounted in the pot-shaped piston 35, which is constructed as a hollow cylinder. The percussion piston 42 is provided at its outer periphery with an annular groove 43, in which a sealing ring 44 is located. The sealing ring 44 is under radial compression between the base of the annular groove 43 and the inner surface of the pot-shaped piston 35. The sealing ring 44 has some play in the axial direction in the annular groove 43. An air space 45 of variable length and enclosing an air pillow is located between the closed end of the cup-shaped piston 35 and the percussion piston 42. Starting from this air space 45, the piston 42 is provided with a longitudinal bore 46 which terminates in the annular groove 43. The sealing ring 44 forms, depending on its axial position within the annular groove 43, a valve element for closing the bore 46. If the bore 46 is not closed by means of the sealing ring 44, it will communicate with the annular groove 43 and, depending on the position of the percussion piston 42 relative to the pot-shaped piston 35 also with the ventilating opening 40. As already mentioned, the ventilating opening 40 moves into alignment with the lubricating opening 39, but the opening 40 is also over the groove 41 continuously in communication with the interior of the housing part 4. The action of the ventilating opening 40 and the annular groove 43 for the purpose of assuring during operation of the device a sufficient amount of air in the interior of the pot-shaped piston, is more clearly described in the German patent application P 31 21 616.1 of June 12, 1981.

Figure 2:
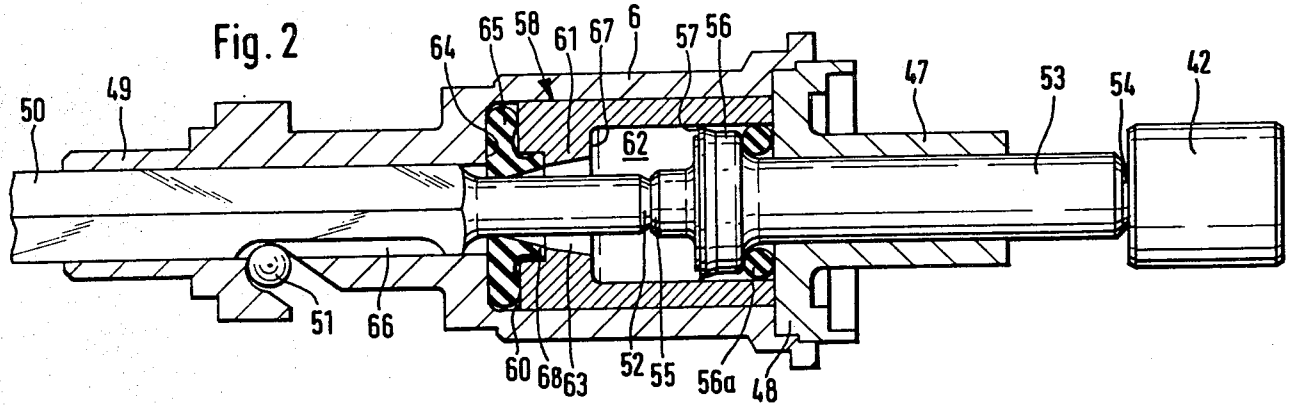
FIG. 2 is an axial cross section through part of the tool shown in FIG. 1 drawn on an enlarged scale.

An anvil guide bushing 47 is mounted in the housing parts 4 and 5 coaxial with the guide bushing 38. For this purpose, the anvil guide bushing 47 is provided at one end thereof with a flange 48 engaging into a corresponding cut-out provided at one end of the tubular housing part 6 coaxial with the anvil guide bushing 47. The housing part 6 projects beyond the housing part 5 and forms with this projecting part a tool receiving portion 49. A tool 50 is insertable into the tool receiver 49. The tool 50 is secured against dropping out or being thrown out from the tool receiver 49 by a locking bolt 51, the inner portion of which engages into a groove 66 formed in the tool so that the latter may be reciprocated within certain limits. The tool 50 has a shank end 52 which extends into the housing part 6. An anvil 53 is reciprocatably mounted in the anvil guide bushing 47 between the shaft end 52 and the percussion piston 42. The anvil 53 has an end 54, against which the percussion piston 42 acts during operation of the device, and another end 55 directed toward the shaft end 52. Adjacent to the end 55 the anvil 53 is provided outside of the anvil guide bushing 47 with an annular flange 56 having a coaxial stripping lip 57. A cushioning ring **56*a* is located between the flange 56 and the end 48 of the anvil guide bushing 47. An impact body 58 is arranged within the tubular housing part 6 movable in longitudinal direction of the anvil 53. The impact body 58 has an end face 59 directed toward the end 48 of the anvil guide bushing 47 and an opposite end face 60 directed toward the tool receiver 49. The impact body 58 is constructed as a hollow cylinder with a cavity 62 having an open end at the end face 59 and which reaches up to an inwardly extending flange 61 adjacent to the end face 60. The diameter of the cavity 62 and the outer diameter of the stripping lip 57 are correlated in such a manner that these parts are axially movable with slight play with respect to each other. The annular flange 61 is provided with an opening 63 through which the shaft end 52 of the tool 50 extends with considerable clearance. An abutment face 64 is formed at the transition of the tool receiver 49 with the tubular housing part 6 and a cushioning ring 65 of rubber-elastic material is inserted between this abutment face 64 which is directed against the impact body 58 and the latter. The abutment face 64 and the end face of the flange 48 of the anvil guide bushing 57 form respectively abutment faces for the cushioning ring 65 and the impact body 58. The cushioning ring 65 biases the impact body 58 against the flange 48 of the anvil guide bushing 47. The thereby resulting orientation of the impact body 58 is shown in FIGS. 1 and 2. FIG. 1 illustrates for the normal operation of the device the position of the anvil 53 and the tool 50 which will result if the device and the tool 50 is pressed against a workpiece during the impact of the percussion piston 42 against the end 54 of the anvil. In this position of the parts 50, 53 and 42 the flange 56 of the anvil can press the cushion ring 56*a* onto the end 48 of the anvil guide bushing 47. Due to the impact of the percussion piston 42 onto the end 54 of the anvil 53, the latter will be accelerated and now accelerates by means of its end 55 the tool 50 at its shaft end 52. At a sufficient resistance at the workpiece, there remains despite the movement of the flange 56 in the direction toward the flange 61 of the impact body 58 a distance between these two flanges. The cushioning ring 56*a* serves upon rebound of the tool 50 from the workpiece to catch the tool 50 and the anvil 53** accelerated by the same.

Figure 3:
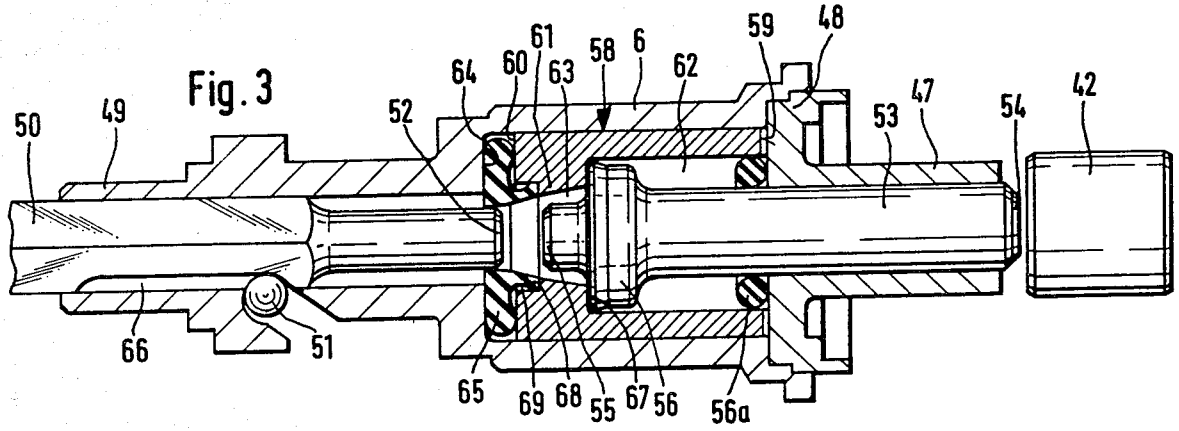
FIG. 3 is an axial cross section of the part shown in FIG. 2 showing the various elements in a different position.

In the event that the tool 50 does not find any resistance, it will, as shown in FIG. 3 be braked by the locking bolt 52 which engages into the cut-out 66 provided in the tool 50 and thus prevented from dropping out from the tool receiver 49. Thereby the shaft end 52 is moved so far so as to be located outside of the impact body 58. The movement of the anvil 53 toward the tool receiver 49 is smaller than that of the tool 50. Thereby the flange 56 will abut against the abutment faces 57 formed by the flange 61 of the impact body, as shown in FIG. 3. Due to this abutment, the impact body 58 is accelerated toward the tool receiver 49. A gap will thus form between the end 48 of the anvil guide bushing and the end face 59 of the impact body 58, whereas the cushioning ring 65 between the end face 60 of the impact body 58 and the abutment face 64 will be compressed. The masses of the anvil 53 and the impact body 58 are chosen in such a manner that the anvil 53 during the abutment will first be arrested and subsequently thereto be moved at very low speed rearwardly in direction toward the percussion piston 42, which speed will, due to the friction of the anvil 53 in the anvil guide bushing 47, be reduced to zero at a short travel period. This will be obtained if the impact body 58 and the anvil 53 have essentially the same weight or if the anvil 53 is slightly lighter than the impact body 58. The exact selection of the two masses will depend on the damping characteristics of the used materials and can be easily obtained by corresponding experiments. Thereby the anvil will practically transmit its total kinetic energy to the impact body. The impact body 58 will therefore at first move away from the flange 56 of the anvil 53. Finally, the impact body 58 will be braked by the cushioning ring 65 and accelerated in direction of the anvil guide bushing 47 to abut against the flange 48 of the latter. Therefore, the impact body 58 comes not into contact with the anvil 53, since the latter has been displaced, from that position at which the impact of the anvil against the impact body occurred, through a distance in direction toward the percussion piston 42. This distance will assure that the kinetic energy transmitted per impact onto the impact body 58 will not be retransmitted onto the anvil 53. At a horizontal guiding of the apparatus the anvil 53 will therefore, after a so-called idle stroke, be prevented from approaching the percussion piston 42 so as to be hit by the latter. Since at an upwardly inclined position of the apparatus the anvil 53 may due to its own weight, slide downwardly in the anvil guide bushing 47 to thereby be located within the moving path of the percussion piston 42, it is advisable when the apparatus should be used in an upwardly extending position, to provide a non-illustrated additional braking or holding device for the anvil 53. Such a braking or holding device could consist of an elastic braking ring known in the art similar to a braking ring as described in the British Pat. No. 1,424,473. Due to the described function of the impact body 58 and the cushioning ring 65 cooperating therewith, such a braking ring need only exert a small fraction of such forces onto the anvil 53, which the braking ring on the above described known machine has to provide.

As clearly shown in FIGS. 2 and 3, the cushioning ring 65 is constructed in such a manner that it will act as a sealing ring onto the shaft end 52 of the tool 50. The cushioning ring 65 serves therefore not only for damping the impact but also to prevent penetration of mineral dust or the like along the tool receiver into the interior of the device. A support collar 68 is integrally formed on the cushioning ring 65 in order to prevent that during insertion of the tool 50 into the tool receiver 49 the cushion ring 65 is displaced too far in the direction towards the anvil 53. The support collar 68 widens in the direction toward the anvil 53 in form of a funnel and elastically abuts within a cut-out 69 on the impact body 58. This cut-out 69, which extends from the end face 60 into the impact body 58, centralizes the cushioning ring 65. The outer periphery of the cushioning ring 65 is radially spaced from the inner surface of the housing part 6. The stripping lip 57 on the flange 56 of the anvil 53 will additionally serve to prevent penetration of stone dust between the anvil 53 and the anvil guide bushing 47 in the event that the tool 50 at an upwardly inclined position of the apparatus is removed therefrom. The collected stone dust may be emptied from the apparatus by downwardly inclining the same.

It will be understood that each of the elements described above, or two or more together, may also find a useful application in other types of motor-driven hand-held percussion tools differing from the types described above.

While the invention has been illustrated and described as embodied in a motor-driven hand-held percussion tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A motor-driven hand-held percussion tool comprising a housing forming at one end a tool receiver having an axis; a tool axially guided in the tool receiver and having an inner end; a percussion piston coaxial with said axis spaced from said inner end and axially reciprocatable in said housing; motor driven air cushion striking means cooperating with said percussion piston for reciprocating the latter; an elongated anvil reciprocatably guided between said inner end of said tool and said percussion piston and movable to an idle stroke position; an impact body guided in longitudinal direction of said elongated anvil and having an abutment face impingeable by said anvil, said housing having rearwardly of said tool receiver, a portion guiding said impact body; and a rubber-elastic cushioning ring sandwiched between a face of said impact body opposite said abutment face and a corresponding opposite face of said tool receiver, said cushioning ring having radially inwardly a portion elastically surrounding said inner end of said tool so as to form a sealing ring, and said cushioning ring having a radially outwardly extending portion having a peripheral surface radially spaced from said portion of said housing guiding said impace body, the mass of said impact body being substantially equal to the mass of said anvil, whereby when said tool is disengaged from a workpiece, said anvil will be moved to said idle stroke position in which a rear end of said anvil will not be contracted by said percussion piston.

2. A percussion tool as defined in claim 1, wherein said impact body has an inwardly extending collar facing said cushioning ring, and wherein the latter has starting from its inner periphery a support collar directed toward said collar of said impact body.

3. A percussion tool as defined in claim 2, wherein said collar of said impact body is provided with an annular cut-out into which said support collar extends.

4. A percussion tool as defined in claim 1, wherein said motor-driven percussion striking means comprises a piston coaxial with said percussion piston and including a guide tube in said housing guiding said piston and said percussion piston for reciprocation, and rubber-like damping elements between said housing and said guide tube.

5. A motor-driven hand-held percussion tool comprising a housing forming at one end a tool receiver having an axis; a tool axially guided in the tool receiver and having an inner end; a percussion piston coaxial with said axis spaced from said inner end and axially reciprocatable in said housing; motor-driven air cushion striking means cooperating with said percussion piston for reciprocating the latter, said motor-driven percussion striking means comprising a piston coaxial with said percussion piston and including a guide tube in said housing guiding said piston and said percussion piston for reciprocation, and rubber-like damping elements between said housing and said guide tube, said damping elements being constituted by rings and said guide tube being provided with annular grooves in which said rings are engaged; an elongated anvil reciprocatably guided between said inner end of said tool and said percussion piston and movable to an idle stroke position; an impact body guided in longitudinal direction of said elongated anvil and having an abutment face impingeable by said anvil; and a rubber-elastic cushioning ring sandwiched between a face of said impact body opposite said abutment face and a corresponding opposite face of said tool receiver, the mass of said impact body being substantially equal to the mass of said anvil, whereby when said tool is disengaged from a workpiece, said anvil will be moved to said idle stroke position in which a rear end of said anvil will not be contacted by said percussion piston.

6. A percussion tool as defined in claim 5, wherein two such rings are provided, one of which is fixed in the housing in axial and radial direction, and the other of which is arranged movable in the axial direction of said guide tube.

7. A motor-driven hand-held percussion tool comprising a housing forming at one end a tool receiver having an axis; a tool axially guided in the tool receiver and having an inner end; a percussion piston coaxial with said axis spaced from said inner end and axially reciprocatable in said housing; motor-driven air cushion striking means cooperating with said percussion piston for reciprocating the latter; an elongated anvil reciprocatably guided between said inner end of said tool and said percussion piston and movable to an idle stroke position; an impact body guided in longitudinal direction of said elongated anvil and having an abutment face impingeable by said anvil, said impact body having a cavity coaxial with said anvil and wherein the latter has an annular sealing lip directed toward said tool receiver, axially movable in said cavity and extending up to the inner periphery thereof; and a rubber-elastic cushioning ring sandwiched between a face of said impact body opposite said abutment face and a corresponding opposite face of said tool receiver, the mass of said impact body being substantially equal to the mass of said anvil, whereby when said tool is disengaged from a workpiece, said anvil will be moved to said idle stroke position in which a rear end of said anvil will not be contacted by said percussion piston.

8. A motor-driven hand-held percussion tool comprising a housing forming at one end a tool receiver having an axis; a tool axially guided in the tool receiver and having an inner end; a percussion piston coaxial with said axis spaced from said inner end and axially reciprocatable in said housing; motor-driven air cushion striking means cooperating with said percussion piston for reciprocating the latter, said motor-driven percussion striking means comprises a piston coaxial with said percussion piston and including a guide tube in said housing guiding said piston and said percussion piston for reciprocation, said guide tube being formed of plastic material reinforced by fibers, and rubber-like damping elements between said housing and said guide tube; an elongated anvil reciprocatably guided between said inner end of said tool and said percussion piston and movable to an idle stroke position; an impact body guided in longitudinal direction of said elongated anvil and having an abutment face impingeable by said anvil; and a rubber-elastic cushioning ring sandwiched between a face of said impact body opposite said abutment face and a corresponding opposite face of said tool receiver, the mass of said impact body being substantially equal to the mass of said anvil, whereby when said tool is disengaged from a workpiece, said anvil will be moved to said idle stroke position in which a rear end of said anvil will not be contacted by said percussion piston.

* * * * *